US006478345B1

(12) United States Patent
Viney

(10) Patent No.: US 6,478,345 B1
(45) Date of Patent: Nov. 12, 2002

(54) MULTI POINT BOLTING MECHANISM

(75) Inventor: Bernard J. Viney, Winnersh (GB)

(73) Assignee: Surelock McGill Limited (GB)

( * ) Notice: Subject to any disclaimer, the term of this patent is extended or adjusted under 35 U.S.C. 154(b) by 51 days.

(21) Appl. No.: 09/689,969

(22) Filed: Oct. 12, 2000

(30) Foreign Application Priority Data

Oct. 13, 1999 (GB) ..... 9924245

(51) Int. Cl.[7] ..... E05C 1/06

(52) U.S. Cl. ..... 292/39; 70/108; 70/111; 70/DIG. 42

(58) Field of Search ..... 292/39, 51, 160, 292/172, 142, 144, 3–55; 70/103, 120, 190; 74/422, 89.17, 89.16, 533; 49/287

(56) References Cited

U.S. PATENT DOCUMENTS

| | | | | |
|---|---|---|---|---|
| ,430,072 A | | 6/1890 | Dowd | |
| 1,152,776 A | | 9/1915 | Wolfe | |
| 1,179,731 A | | 4/1916 | McDonald | |
| 1,968,285 A | | 7/1934 | Egan | 292/172 |
| 2,125,227 A | | 7/1938 | Hammarle | 70/118 |
| 2,594,253 A | | 4/1952 | Veer | 292/92 |
| 2,823,536 A | | 2/1958 | Watson | 70/1.5 |
| 3,637,277 A | | 1/1972 | Krug et al. | 312/217 |
| 3,765,198 A | | 10/1973 | Horgan, Jr. | 70/92 |
| 3,792,885 A | | 2/1974 | Giardina et al. | 292/39 |
| T978,006 I4 | | 1/1979 | Carman et al. | 292/41 |
| 4,248,452 A | | 2/1981 | Allenbaugh | 292/167 |
| 4,799,718 A | | 1/1989 | Ing | 292/36 |
| 5,083,448 A | | 1/1992 | Karkkainen et al. | 70/277 |
| 5,245,846 A | | 9/1993 | James | 70/118 |
| 5,290,077 A | | 3/1994 | Fleming | 292/35 |
| 5,495,731 A | * | 3/1996 | Riznik | 292/39 |
| 5,516,160 A | * | 5/1996 | Kajuch | 292/1.5 |
| 5,524,941 A | | 6/1996 | Fleming | 292/34 |
| 5,531,493 A | | 7/1996 | Reynolds | 292/32 |
| 5,570,913 A | | 11/1996 | Puric | 292/36 |
| 5,603,534 A | | 2/1997 | Fuller | 292/2 |
| 5,683,122 A | | 11/1997 | Lee | 292/39 |
| 5,820,177 A | * | 10/1998 | Moon | 292/335 |
| 5,865,479 A | * | 2/1999 | Viney | 292/39 |

FOREIGN PATENT DOCUMENTS

| | | |
|---|---|---|
| EP | 0 021 820 | 1/1981 |
| EP | 0 742 332 A1 | 11/1996 |
| GB | 13633 | 6/1914 |
| GB | 14868 | 10/1916 |
| GB | 590813 | 7/1947 |
| GB | 669066 | 3/1952 |
| GB | 1021089 | 2/1966 |
| GB | 1363050 | 8/1974 |
| GB | 1364444 | 8/1974 |
| GB | 2096686 | 10/1982 |
| GB | 35 20 861 A1 | 12/1986 |
| GB | 40 12 002 A1 | 1/1991 |
| GB | 2259110 | 3/1993 |
| GB | 42 09 855 A1 | 9/1993 |
| WO | WO 97/35084 | 7/1997 |

* cited by examiner

*Primary Examiner*—Robert J. Sandy
(74) *Attorney, Agent, or Firm*—Theodore M. Magee; Westerman, Champlin & Kelly, P.A.

(57) ABSTRACT

A mechanism for providing a multi point bolting action to secure a door or other leaf movable within a frame is disclosed. The mechanism comprises a drive gear and an axle gear mounted to rotate about substantially the same axis. The idle gear is arranged to rotate in one sense when the drive gear rotates in the other sense. The mechanism also comprises at least one first member arranged to move between a thrown position and a retracted position when the drive gear rotates, and at least one second member arranged to move between a thrown position and a retracted position when the idle gear rotates. The first and second members are each provided with a rack held in intermeshing engagement with the appropriate gear.

8 Claims, 4 Drawing Sheets

150
162
164
236
234
228
238
232
220
54
230
222
224
108
106
160
226
152
154
240
68
50
156
210
208
64
200
202
102
204
100
206
98
166
96
168
86
66
92
80
Z
170
104
Z
116
88
112
184
88
58
94
254
60
250
52
252
256
126
120
56
260
258
124
72
182
122
70
180

MULTI POINT BOLTING MECHANISM

BACKGROUND OF THE INVENTION

The present invention relates to a multi point bolting mechanism, and in particular, but not exclusively, to a locking bolting mechanism for providing a multi point bolting action to secure a leaf within a frame.

Bolting mechanisms providing a multi point bolting action are well known for fastening hinged doors, windows and other types of leaf within a frame, with considerably more security than if a single point bolt action is used. A multi point bolting action may be particularly desirable on doors at the entrances to buildings, on secure containers, the rear doors of vans and lorries and for many other applications. Three point bolting mechanisms are particularly common, although mechanisms with two, four or more bolting actions are known.

In a three point bolting mechanism mounted on or in a door hinged to swing about an upright axis, a main bolt is usually slidable from the mechanism into a recess or fitting of the unhinged upright side of the door frame. A three point bolting mechanism usually then provides additional top and bottom bolting actions by sliding top and bottom bolts into recesses or fittings of the top and bottom horizontal sections of the door frame. The top and bottom bolts are mechanically coupled to and operate simultaneously with the main bolt.

A simplified illustration of a three point bolting mechanism of the prior art is shown in FIG. 1. The following description supposes that the bolting mechanism is mounted on a main face of a door hinged about a vertical axis within a rectangular frame.

A toothed drive gear 10 is rotatable about a horizontal axis by means of a shaft passed through a central shaft hole 12, the shaft being turned by a handle, a push bar or other device, The top of the drive gear is in meshed engagement with a toothed rack portion 14 of a lower edge of a horizontally extended main bolt 16, which extends through an aperture in a vertical side 18 of the mechanism casing 20. The main bolt is constrained to move horizontally. Rotation of the drive gear causes the main bolt 16 to move horizontally, extending further out of or retracting back into the casing 20 and therefore providing a bolting action into a recess or fitting of an unhinged upright side of the rectangular frame. A toothed rack portion 22 of an upper edge of the main bolt 16 is held in meshed engagement with an idle gear 24 which is of a similar size and is mounted in the same plane as the drive gear 10. The idle gear, mechanically linked to the drive gear by means of the main bolt, counter rotates when the drive gear rotates.

One side of the drive gear 10 engages a toothed rack portion 26 of a side of a vertically extended lower pushrod 28. The lower pushrod passes through a close fitting aperture in a bottom side 30 of the casing 20. When the drive gear 10 rotates, the lower pushrod is driven further out of or retracted into the casing, providing a bolting action into the rectangular frame by means of a bolt positioned near the bottom of the door and mechanically linked to the lower pushrod. The idle gear 24 similarly acts on a toothed rack portion 32 of one side of a vertically extended upper pushrod 34, which is constrained to move vertically, providing a bolting action into a top part of the frame.

The prior art three point bolting mechanism described above may be provided with a key cylinder or other key accepting mechanism which acts on some part of the bolting mechanism in order to provide a secure locking procedure. However, because the drive and idle gears of the bolting mechanism lie in substantially the same vertical plane, below and above the toothed rack portions of the main bolt, the casing of the mechanism described needs to be quite long from top to bottom. The addition of a key cylinder and the associated mechanisms above the slave gear or below the drive gear would make the casing even longer. A long casing is particularly inconvenient if the mechanism is to be mounted inside a door in a mortice configuration, because a very long slot must be cut into the door edge. This is a time consuming process when fitting the mechanism into the door, and moreover may weaken the door unduly.

It would therefore be desirable to provide a multi point bolting action mechanism in a more compact configuration, so that a key cylinder and other desirable mechanisms may be incorporated while maintaining a mechanism casing of convenient size.

SUMMARY OF THE INVENTION

Accordingly, the present invention provides a mechanism for providing a multi-point bolting action to secure a leaf moveable within a frame, comprising:

a drive gear and an idle gear mounted to rotate about substantially the same axis, said idle gear being arranged to rotate in one sense when said drive gear rotates in the other sense;

at least one first member having a rack which is held in intermeshing engagement with said drive gear, said at least one first member being arranged to move between a thrown position and a retracted position when said drive gear rotates;

and at least one second member having a rack which is held in intermeshing engagement with said idle gear, said at least one second member being arranged to move between a thrown position and a retracted position when said idle gear rotates.

Advantageously, the mechanism further comprises a gear train arrangement comprising at least two further gears, a first of the further gears being in intermeshing engagement with said drive gear, and a second of the further gears being in intermeshing engagement with said idle gear.

Advantageously, the at least two further gears comprise third and fourth gears, said third gear being in intermeshing engagement with said drive gear and with said fourth gear, said fourth gear being in intermeshing engagement with said idle gear and with said third gear.

Conveniently, at least one of said members comprises a pushrod that is connected to a bolt, said pushrod and said bolt being arranged to secure said leaf within said frame when said drive gear rotates in one sense, and to release said leaf when said drive gear rotates in the other sense.

Advantageously the mechanism further comprises:

a casing housing the mechanism, the casing comprising a fore-end plate which is located adjacent to the frame when the leaf is positioned fully within the frame;

a bezel plate that is removably mounted to the fore-end plate;

a strike head that is arranged to be rotatable about and moveable along a strike head axis substantially normal to said fore-end plate, said strike head being arranged to move within an aperture in said fore-end plate and within a corresponding aperture in said bezel plate, and being arranged to restrain or release at least one of said members by an action of said frame on said strike head, said aperture in said fore-end plate allowing rotational motion of said strike head about said strike head axis and said aperture in said bezel plate restricting the rotational motion of said strike head about said strike head axis.

Conveniently, said aperture in said fore-end plate is circular and said corresponding aperture in said bezel plate is rectangular.

Advantageously, the mechanism further comprises a strike body arranged to be movable along said strike head axis between a retracted and an extended travel limit, said travel limits being defined relative to said casing, wherein said strike head is connected to said strike body by threaded means aligned along said strike head axis such that rotation of said strike head about said strike head axis alters the relative positions of said strike head and said strike body in the direction of said strike head axis.

BRIEF DESCRIPTION OF THE DRAWINGS

An embodiment of the present invention will now be described by way of example with reference to the accompanying drawings in which.

A DETAILED DESCRIPTION OF THE DRAWING

Figure 2:
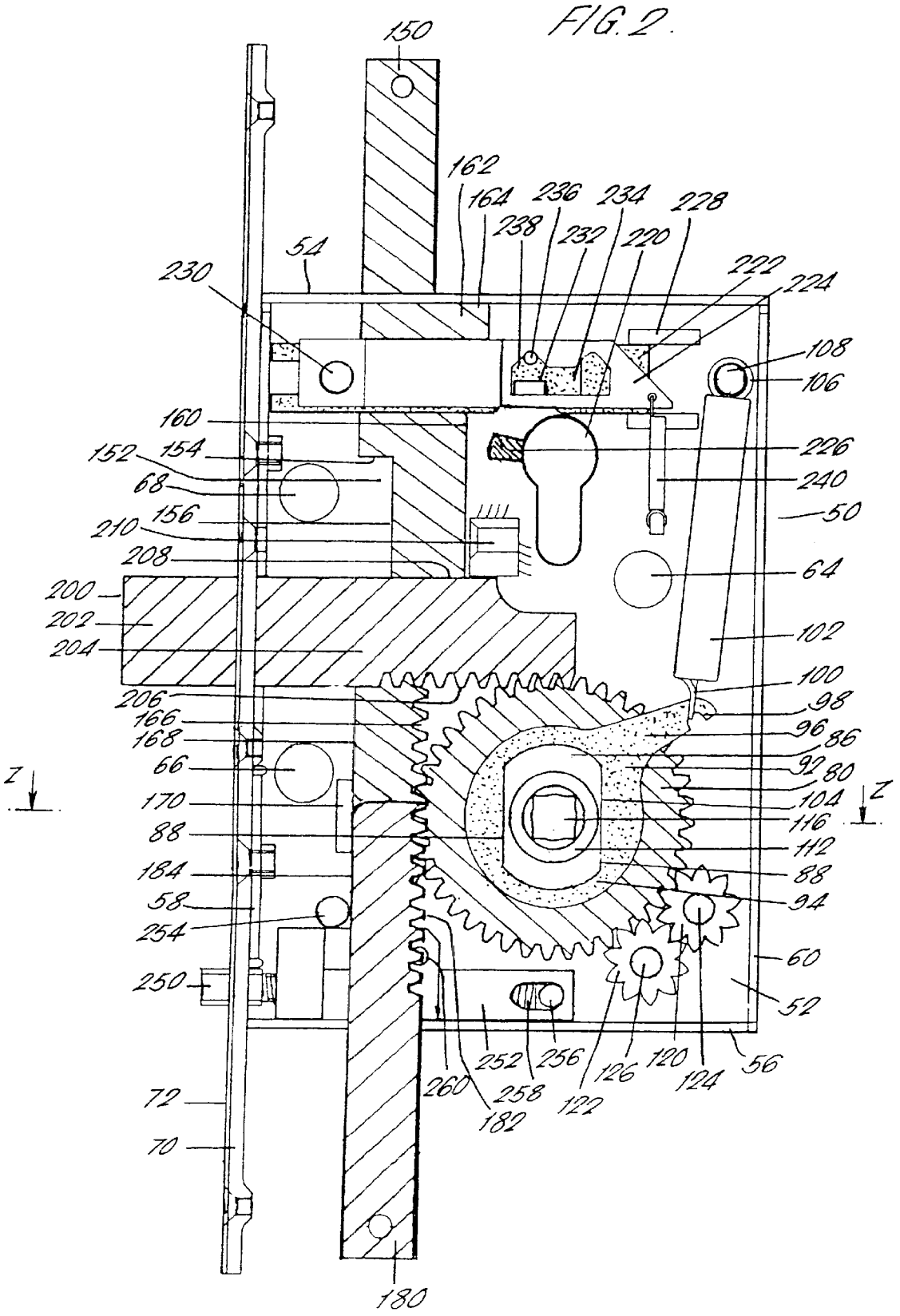
FIG. 2 is a front view of a three point bolting mechanism embodying the present inventions shown in the thrown position and with the drive gear removed.

Referring now to FIG. 2 there is shown a front view of a three point locking bolting mechanism which embodies the present invention. The locking bolting mechanism shown is in a mortice configuration, designed to be fitted into a slot cut into an unhinged edge face of a door, window or other leaf within a frame. The design also allows normal surface mounting, for example to one of the two main faces of a door.

Figure 3:
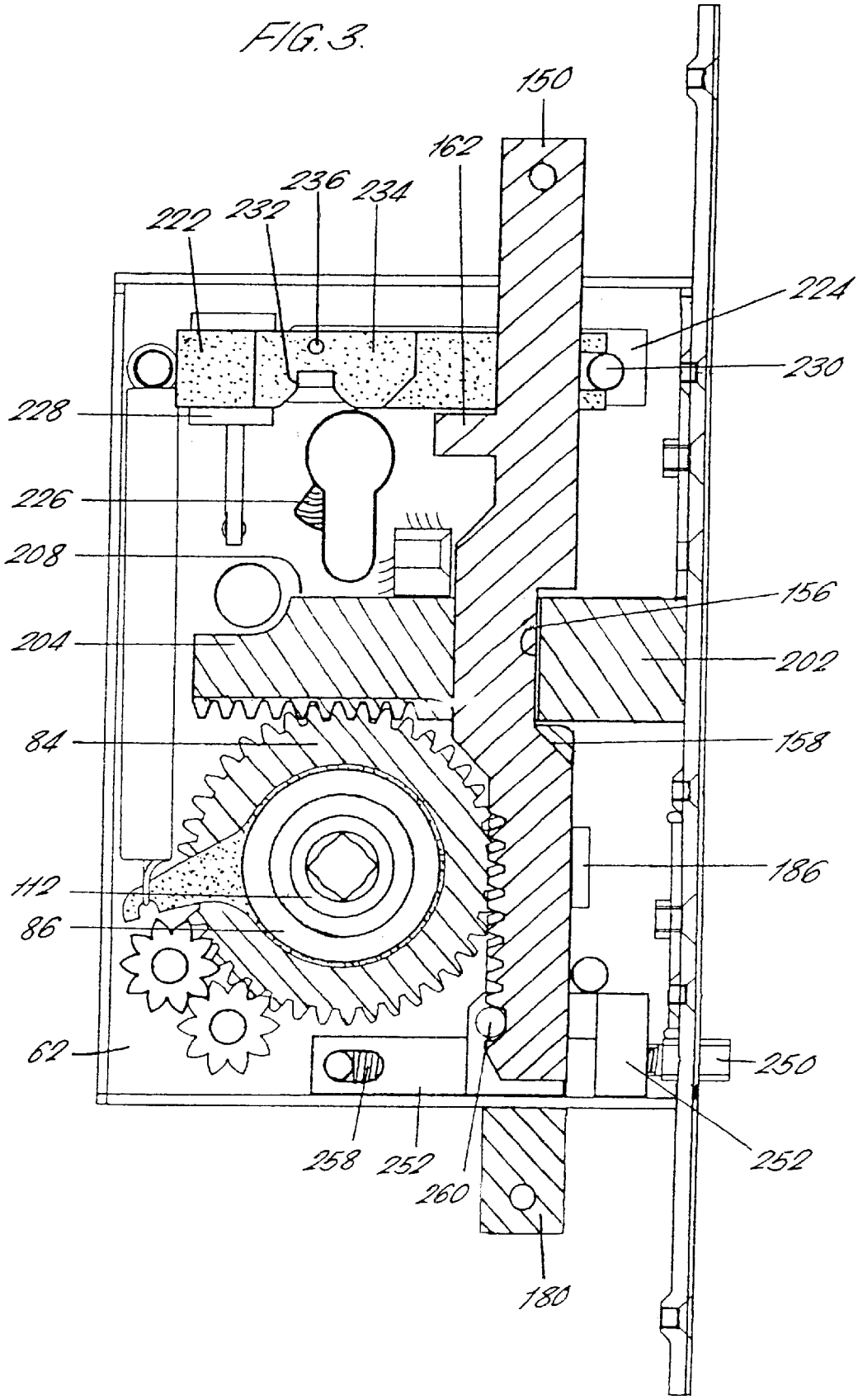
FIG. 3 is a rear view of the three point bolting mechanism of FIG. 2, shown in the withdrawn position and with the idle gear removed.

The terms 'front' and 'back' will be used in this description merely for convenience to denote the sides of the mechanism from which the views of FIGS. 2 and 3 respectively are shown. Thus the drive gear 82 of the present embodiment is positioned towards the front of the mechanism and has been removed for convenience from the front view shown in FIG. 2, while the idle gear 80 is positioned towards the back of the mechanism and has been removed from the back view of FIG. 3. The terms front and back are in no way intended to limit the way in which the described embodiment or any other embodiments may be positioned in use.

It will be assumed in the description that follows that the locking bolting mechanism of the present embodiment is mounted into the unhinged edge face of a door that is hinged about a vertical axis within a rectangular frame. It will therefore be assumed that the fore end plate 70 of the mortice configuration bolting mechanism is screwed onto the vertical unhinged edge face of the door. Of course, the locking bolting mechanism could equally well be used in any other convenient orientation or position such as at the top edge of a door, or on one edge of a horizontally mounted trap door. It could also be used on any other kind of leaf within a frame, such as a window, a removable unhinged panel or a trap door, or in any other situation where a multi point bolting action is desired. The mechanism could also be mounted on or within a frame within which a leaf is to be secured.

The terms door edge side and door centre side will be used to refer to the sides of the locking bolting mechanism towards and away from the adjacent door edge respectively. Thus the fore end plate 70 may be described as being on the door edge side of the mechanism.

Figure 4:
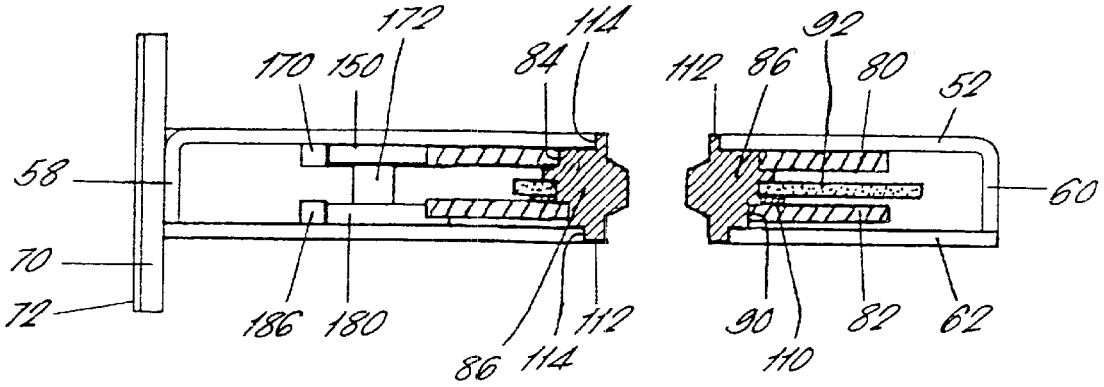
FIG. 4 is a section along line Z—Z of FIG. 2

The locking bolting mechanism shown in FIGS. 2, 3 and 4 comprises a number of components and assemblies housed within a casing 50. The back plate 52 of the casing is formed from a steel plate cut and pressed to also form three of the side plates of the casing, namely, a bottom plate 56, a door edge side plate 58 and a door centre side plate 60. The front plate 62 of the casing has been removed and so is not shown in the front view of FIG. 2, but is made from a substantially flat pressed steel plate, and is pressed to also form the top plate 54. The front plate of the casing is securely attached to the back of the casing by means of screws or bolts received within threaded apertures of a number of pillars 108, 124, 126, 230, 254 which are securely mounted on the backplate. Various parts of the mechanisms contained in the casing comprise further pillars which may also bridge the gap between the back plate and front plate, providing further strength to the assembly. The front and back plates are further spaced by a number of spacer columns 64, 66, 68.

A fore-end plate 70, made from pressed steel, stainless steel or another suitable material is fastened by screws to the outside of the door edge side plate 58. The fore-end plate of the mortice mounted mechanism shown in FIG. 2 extends beyond the door edge side plate in all directions, but particularly in the vertical direction to allow screws passing through the fore-end plate to be used to secure the mechanism to the door. A fore-end bezel 72 fastened on top of and covering the fore-end plate maybe used principally to provide a neat finish to the mounted bolting mechanism, but may also be used for other purposes.

Figure 1:
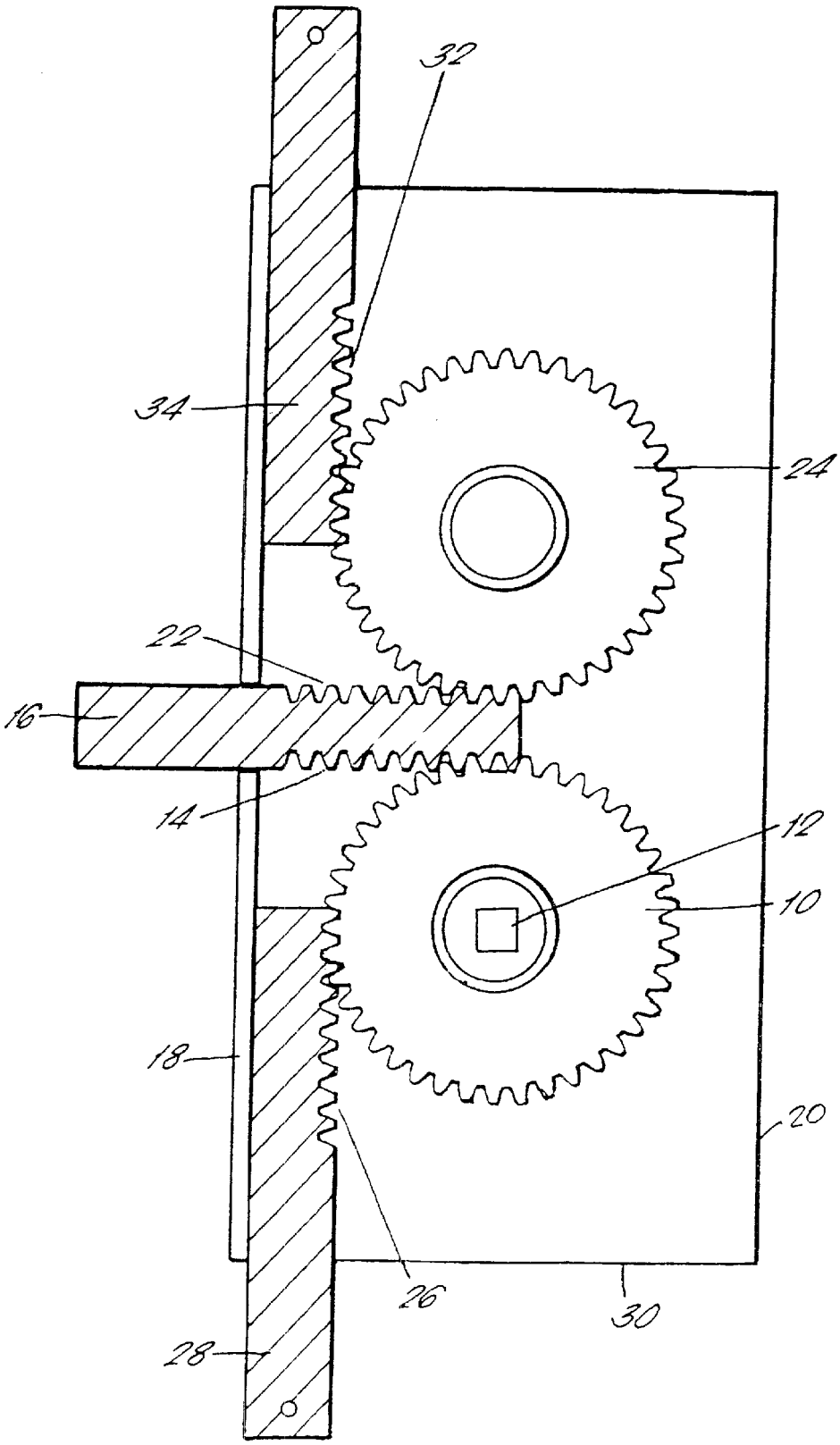
FIG. 1 is a simplified diagram of a three point bolting mechanism of the prior art.

Contained within the casing are an upper pushrod 150 a lower pushrod 180, a main bolt 200, an idle gear 80 and a drive gear 82. These components broadly correspond to the equivalent components described above in relation to the prior art as shown in FIG. 1. However, whereas the drive and idle gears of the prior art are spaced from each other vertically, the drive and idle gears of the present embodiment are mounted coaxially in the lower half of the casing 50.

The upper pushrod, lower pushrod and main bolt of the present embodiment are arranged to move simultaneously between a retracted position and a thrown position by means of the drive gear, the idle gear, and first and second small gears 120, 122. When in the thrown position the pushrods and main bolt extend further out of the casing than when in the retracted position. Towards the top of the casing a deadlocking mechanism is provided to secure the upper pushrod in either the thrown or retracted position. Towards the bottom of the casing a strike mechanism is provided to restrain the upper pushrod in the retracted position when the door is open.

The toothed idle gear 80 and the toothed drive gear 82 are about the same size as each other and have a similar number of teeth. They are mounted coaxially and parallel to the plane of the back plate 52. Each of these two gears may conveniently be made from a double thickness of pressed steel. In FIG. 2 the drive gear has been removed, so that only the idle gear is shown. The idle gear 80 is in the shape of an externally toothed annulus. The inside circular edge surface 84 of the annulus is accepted over a circular portion of the boss, so that the idle gear when mounted is free to rotate independently of the boss.

The drive gear 82 is not shown in FIG. 2, but may be seen in FIG. 3. Like the idle gear it takes the shape of an externally toothed annulus. The drive gear is coaxially mounted on a circular portion of the boss 86. This circular portion of the boss is provided with opposing flattened edges 88. The inside circular edge surface 90 of the drive gear is provided with corresponding flattened portions so that when the drive gear is mounted on the boss the two are fixed to corotate.

A drive hook 92 is mounted on the boss between the drive gear and the idle gear. The drive hook comprises an annular portion 94 mounted coaxially on the boss and a substantially radial arm 96 provided with a notch 98 positioned adjacent to the outside end that accepts an end loop 100 of a tensioned helical main spring 102. The drive hook is fixed so as to corotate with the boss and the drive gear, by means of flattened portions 104 provided on the inside circular edge of the drive hook annular portion engaging the opposing flattened edges 88 of the circular portion of the boss 86 that also accepts the drive gear.

The helical tensioned main spring 102 is mounted between the notch 98 on the radial arm 96 of the drive hook and a main spring anchor 108. The main spring anchor may comprise a pillar mounted between the back plate 52 and front plate 62 of the casing.

When the boss 86 rotates in one sense, the drive hook 92 rotates about the same axis and the main spring 102 is stretched. When the boss rotates in the other sense the spring contracts. The main spring thus provides a restoring torque to the rotation of the boss.

An annular spacer ring 110, not shown in FIG. 2 but shown in the cross sectional view 'Z—Z' of FIG. 4, is provided between the drive hook 92 and the drive gear 82. The spacer ring may be made of pressed steel.

Each axial end of the boss 86 comprises an annular rim 112 that is accepted within a circular aperture 114 in the front plate 62 or the back plate 52 of the casing, as appropriate. The boss is therefore able to rotate freely within the casing. A handle shaft aperture 116 of square cross section is provided axially through the centre of the boss. A square section shaft may then be used to couple action of one or more handles, push bars or other devices which may be mounted on one or both of the main faces of the door to the rotation of the boss. The handle shaft aperture could equally well be splined or of another suitable cross section.

A gear train comprising a first small gear 120 and a second small gear 122, mounted on axes parallel to the axis of the boss 86, provides a mechanical rotational connection between the rotation of the idle gear 80 and the rotation of the drive 82. The gear train is positioned towards the door centre side lower corner of the casing 50. Each of the two small gears is mounted on a separate pillar 124,126 extending between the back plate and the front plate of the casing. The two small gears are of similar size and have a similar number of teeth.

The first small gear 120 is mounted so as to be in meshed engagement with the idle gear 80 but not with the drive gear 82, while the second small gear 122 is mounted so as to be in meshed engagement with the drive gear but not with the idle gear. The two small gears are mounted in meshed engagement with each other. Thus rotation of the drive gear in one sense causes rotation of the idle gear in the opposite sense.

Each of the small gears 120 and 122 may be made from multiple thicknesses of pressed steel joined together. As an alternatively, they could be manufactured by machining or casting a metal or a plastic. In the present embodiment they are held in suitable positions to mesh with the other gears in the manner already described, by the provision of suitable shoulders or spacers on the pillars 124,126.

The vertically extended upper pushrod 150, constrained to move vertically between thrown and retracted positions, is fitted partly within the casing 50, with its upper end protruding through a close fitting aperture in the top plate 54 of the casing.

The upper end of the upper pushrod may typically be connected to a mechanism such as a connecting pushrod for operating an upper bolt so arranged as to be able to secure the upper edge of the door in relation to the upper horizontal of the door frame. Alternatively, the upper bolt may be provided as an integral part of the upper pushrod. The upper pushrod may conveniently be a flat pressed steel component, with one of the faces of the pushrod in sliding contact with the back plate 52 of the casing.

The door edge side of the upper pushrod 150 is shaped with a bolt recess 152, which has an upper edge 154 aligned horizontally and in the plane of the back plate 52, a side edge 156 aligned vertically, and a truncated lower edge 158. Part of the side of the upper pushrod opposing the bolt recess 152 defines a vertically aligned first guide edge 160. Above the first guide edge, the same side of the upper pushrod is provided with a pushrod stop tag 162, which takes the form of a rectangular projection extending horizontally from the upper pushrod in the plane of the back plate 52. The stop tag 162 presents an upper horizontal edge 164. Below the first guide edge 160 the door centre side of the upper pushrod is provided with a vertically aligned toothed rack 166 having teeth proportioned to mesh with the teeth of the idle gear 80. Opposing the toothed rack 166 the upper pushrod is defined by a vertically aligned second guide edge 168. An upper pushrod guide 170 comprising a lug pressed from the back plate 52 or a tag fixed to the back plate abuts the second guide edge. The upper pushrod guide holds the toothed rack 166 of the upper pushrod in meshed engagement with the idle gear 80, so that rotation of the idle gear 80 moves the upper pushrod vertically.

The upper pushrod 150 is held in sliding contact with the back plate 52 of the casing by the close fitting aperture through which it emerges in the top plate 54, by the main bolt which is aligned perpendicularly across the upper pushrod taking up the remaining thickness of the inside of the casing between the front and back plates, and by a pushrod spacer 172, which is shown in the cross sectional drawing of FIG. 4 and which maintains the lower end of the upper pushrod a minimum distance from the lower pushrod.

The upward thrown limit of travel by the upper pushrod 150 is reached when the upper pushrod stop tag 162 abuts against the internal face of the top plate 54. The downward retracted limit of travel by the upper pushrod is reached when the vertically aligned side edge 156 of the bolt recess 152 in the upper pushrod 150 abuts onto a thick section 202 of the horizontally aligned main bolt 200, at which point further downward motion of the upper pushrod is prevented by action of the main bolt through the drive gear, two small gears and the idle gear. The lower edge 158 of the bolt recess 152 is not square, the outside lower corner of the recess being truncated in such a way that in upward motion from its lower limit of motion, the lower edge 158 of the recess does not collide with the thick section 202 of the main bolt which is simultaneously travelling horizontally.

The vertically aligned lower pushrod 180 is constrained to move vertically between thrown and retracted positions. It is fitted partly within the casing 50 but with its lower end protruding through a close fitting aperture in the bottom plate 56. The lower end of the lower pushrod may be connected to a mechanism such as a connecting pushrod for operating a lower bolt to secure the lower edge of a door with respect to the door frame. Alternatively, the lower bolt may be provided as an integral part of the lower pushrod.

The lower pushrod may conveniently be a flat pressed steel component, and in the present embodiment is of considerably shorter length than the upper pushrod because the idle and drive gears 80 and 82 are located in the lower half of the casing 50. A face of the lower pushrod is held in sliding contact with the front plate 62 of the casing.

An upper portion of the door centre side of the vertically aligned lower pushrod 180 is provided with a toothed rack 182 having teeth proportioned to mesh with the teeth of the drive gear 82. On the opposite side from the toothed rack 182 the lower pushrod is defined by a guide edge 184. A lower pushrod guide 186 comprising a lug pressed from the front plate 62 or a tag fixed to the front plate abuts the guide edge 184, holding the toothed rack 182 in meshed engagement with the drive gear 82 such that rotation of the drive gear moves the lower pushrod vertically.

The lower pushrod 180 is held in sliding contact with the front plate 62 by the close fitting aperture through which it emerges in the bottom plate 56 of the casing 50 and by the pushrod spacer 172, which is shown in the cross sectional drawing of FIG. 4. The pushrod spacer 172 may comprise a lug bent perpendicularly from the upper tip of the lower pushrod, or a boss or captive nut mounted on the rear side of the lower pushrod, or any other convenient spacing means that provides a spacer between the upper and lower pushrods, holding them in sliding contact with the back and front plates of the casing respectively.

The limit of upward travel by the lower pushrod 180 is reached when an upper end of the lower pushrod abuts the main bolt 200, one face of which is also in sliding contact with the front plate 62 of the casing. The downward limit of travel by the lower pushrod is reached when idle gear is prevented from turning further through the upper pushrod 150 reaching its limit of upward travel.

The horizontally extended main bolt 200 comprises a thick section 202 at the door edge end and a plate section 204 at the door centre end, and may, for example, be a steel or brass component, made by machining, casting, or by the joining of pressed steel plates. The thick section 202 of the main bolt is of rectangular cross section, extends through a closely fitting aperture in the door edge side plate 58 of the casing, and occupies the entire depth of the casing between the front and back plates 62,52. The plate section of the main bolt comprises a plate lying adjacent to the front plate of the casing. A part of the lower side of the plate section 204 of the main bolt 200 is provided with a toothed rack 206 having teeth proportioned to mesh with the teeth of the drive gear 82.

The upper side of the plate section 204 of the main bolt is defined by a horizontal guide edge 208 which abuts a bolt guide 210. The bolt guide may comprise a lug or box section pressed from the front plate of the casing, or a pillar bridging between the front and back plates, and ensures a good meshed engagement between the toothed rack 206 of the main bolt and the drive gear 82.

The main bolt 200 is constrained to move horizontally by the drive gear 82, the bolt guide 210, and the close fitting aperture in the door edge side plate 58. The horizontal travel of the main bolt beyond the thrown position is limited by the limit of rotation of the drive gear 82, which is in turn limited through the action of the two small gears and the idle gear by the upward travel of the upper pushrod 150. The horizontal travel of the main bolt beyond the retracted position is limited by the abutting of the thick section 202 of the main bolt against the side edge 156 of the upper pushrod bolt recess 152. At this point, an end surface of the bolt approaches a bolt stop pillar 64, which extends between the back plate 52 and the front plate 62 of the casing.

The deadlocking mechanism, comprising a key cylinder 220, a horizontally extended deadlock plate 222 and a sprung deadlock cam 224 is situated in the upper part of the casing. Horizontal movement of the deadlock plate between a deadlocked position and an unlocked position allows the upper pushrod 150 either to be secured in one of the thrown or retracted positions, or to move freely between the two positions. The key cylinder is mounted in the casing so as to accept a key which, when turned, causes a key cylinder rotor cam 226 to rotate about an axis perpendicular to the back plate 52.

The key cylinder rotor cam engages a recess 232 in the lower edge of the deadlock plate 222. The deadlock plate is located between two deadlock plate guides 228 comprising lugs bent out of the back plate 52. The deadlock plate is further constrained to move horizontally by a deadlock pivot 230 comprising a pillar mounted in the door edge side of the casing. The deadlock pivot engages a horizontal slot cut into the door edge end of the deadlock plate. The deadlock plate may conveniently be made from pressed steel plate.

In order to engage the upper pushrod stop tag 162 and therefore to provide the deadlock function, one part of the deadlock plate is provided with a greater thickness. This thicker section 234, visible in FIG. 3, includes the region of the deadlock plate in which the recess 232 engaged by the key cylinder rotor cam is formed. As the deadlock plate is moved horizontally into the deadlocked position the thicker section of the plate moves into confrontation with either the upper or lower horizontal edge of the upper pushrod stop tag 162, depending on whether the upper pushrod is in the retracted or the thrown position. When in its retracted position the thicker part of the deadlock plate does not come into confrontation with the upper pushrod stop tag, which passes a thinner part of the deadlock plate in sliding contact.

The sprung deadlock cam 224 is provided to prevent the deadlock plate 222 from sliding out of position unintentionally. The deadlock cam may conveniently comprise a pressed steel plate. It overlies the deadlock plate and is pivoted on the deadlock pivot 230. A deadlock plate pin 236 protrudes from the front surface of the deadlock plate adjacent to the recess that engages the key cylinder rotor cam. The deadlock plate pin is held in sliding contact with an upper edge surface of an aperture 238 in the deadlock cam 224.

The aperture 238 in the deadlock cam 224 is in the form of a rectangular slot having two triangular recesses in an upper edge of the slot. The apex of each triangular recess is in such a position that the deadlock plate pin 236 lies at one apex when the deadlock plate is in the thrown position, and lies at the other apex when the deadlock plate is in the retracted position. A deadlock cam spring 240 is anchored at its lower end to the casing 50 and at its upper end to the far end of the deadlock cam from the deadlock pivot. The deadlock cam spring provides a force which tends to hold the deadlock cam in a position in which the deadlock plate pin lies in an apex of one of the triangular recesses in the aperture 238 in the deadlock cam.

The rotation of the key cylinder rotor cam 226 bearing on the lower edge of the deadlock cam causes the deadlock cam 224 to rotate about the deadlock pivot 230 in opposition to the deadlock cam spring 240, lifting the triangular recess clear of the pin. The associated engagement of the key cylinder rotor cam with the recess in the lower edge of the deadlock plate 222 causes the deadlock plate to move horizontally until the pin aligns with the other triangular recess and the deadlock cam rotates back to its original orientation under the action of the deadlock cam spring as the rotor cam continues to rotate. In this way, the sprung deadlock cam tends to hold the deadlock plate in either the deadlocked or the unlocked position.

The strike assembly, which is positioned towards the bottom of the lock casing 50, provides a restraint to hold the upper pushrod in the retracted position, in particular when the door is open. The strike assembly comprises a strike head 250 which is connected to a sprung strike body 252.

The strike head 250 comprises a short rod of square cross section that is constrained to move horizontally between a protruding and a non protruding position through a round hole in the fore-end plate 70. A square hole in the fore-end bezel 72 prevents the strike head from rotating in the bound hole. The end of the strike head that may emerge outside the casing, when the strike head in is the protruding position, is cut at a non-square angle so that a perpendicular impact with a fitting on a door frame drives the strike head into the casing 50. By removing the fore-end bezel the strike head can be rotated within the circular hole of the fore-end plate to place the strike head in the desired orientation, which-will generally depend on the closing direction of the door. On replacing the fore-end bezel, the square hole constrains the strike head to maintain the desired orientation, A threaded portion of the strike head engages a threaded aperture in the strike body 252, which is constrained to move in a horizontal direction by a strike body guide 254 and the bottom plate 56 of the casing. The strike body guide comprises a pillar mounted between the front and back plates of the casing, the upper edge of the strike body being in sliding contact with the pillar.

In addition to rotational adjustments, the position of the strike head relative to the strike body may be adjusted horizontally. This is achieved by rotation of the strike head in conjunction with its threaded engagement with the strike head body. This allows a lateral adjustment of the protruding position of the strike head to more effectively engage a corresponding fitting on a door frame.

A strike body stop 256 is received within a horizontal slot in the strike body, the confrontation of the strike body stop with the ends of the slot defining the limits of travel of the strike body. The strike body stop comprises a pillar mounted between the back plate and front plate of the casing. A strike assembly spring 258, which may conveniently comprise a helical compression spring, is held in a horizontal orientation within an aperture of the strike body that communicates with the slot in the strike body. The spring bears on the strike body stop 256 to provide a restoring force to the horizontal movement of the strike body, tending to push the strike head 250 into the protruding position, in which it protrudes to a maximal extent from the lock casing.

A recess is provided just below the toothed rack in the upper pushrod 150. A strike locking pin 260, mounted on the strike body 252, engages this recess when the pushrod is in the retracted position and the strike head is in the protruding position. The strike locking pin thus holds the upper pushrod in the retracted position until the action, as the door is closed, of the door frame or a component mounted on the door frame on the strike head drives the strike locking pin out of the recess in the upper pushrod. Thus the strike assembly prevents the pushrods and bolt from being moved into the thrown position while the door is open, thereby hindering reclosure of the door.

In FIG. 3 there is shown a rear view of the three point bolting mechanism that is shown from a front view in FIG. 2. Whereas FIG. 2 shows the upper and lower pushrods 150,180 and main bolt 200 in the thrown position, in FIG. 3 they are shown in the retracted position. The deadlock plate 222 is also shown in the retracted position.

In FIG. 3 the back plate and the idle gear have been removed. Although aspects of this drawing have already been mentioned, features that may be more clearly seen than in FIG. 2 will be pointed out.

The upper pushrod 150 is seen as a single plate. The relationship between the upper pushrod stop tag 162 and the thicker section 234 of the deadlock plate 222 can be seen. When the upper pushrod is either in the retracted position as shown, or in the thrown position, sliding the deadlock plate into the deadlocked position prevents the further vertical movement of the upper pushrod because the upper pushrod tag cannot pass the thicker section of the deadlock plate.

In FIG. 3 the upper pushrod 150 is seen overlying the main bolt 200. When in the retracted position, the thicker section 202 of the main bolt abuts the adjacent vertical side edge 156 of the upper pushrod bolt recess 152. From the viewpoint of FIG. 3, the thinner plate section 204 of the bolt underlies the upper pushrod. The truncated lower corner 15 of the upper pushrod bolt recess is visible, and it can be seen that the truncation is necessary to allow clearance between the two components as the upper pushrod moves upwards and the main bolt simultaneously moves outwards into the thrown position.

The strike locking pin 260 is shown engaged in the recess just below the toothed rack of the upper pushrod. The upper pushrod is thus prevented from moving upwards into the thrown position until the strike locking pin is pushed from the recess by action of the strike head 250 on the strike body 252.

A cross sectional view of the three point bolting mechanism along the line Z—Z of FIG. 2 is shown in FIG. 4. Again, aspects this drawing have already been mentioned above, but features that are more clearly seen in this view will be pointed out.

The figure shows a horizontal cross section through the axis of rotation of the boss 86 and idle and drive gears 80 and 82. The boss is rotatably mounted by means of annular rims 112 which fit in circular holes in the back plate 52 and front plate 62 of the casing. The idle gear 80 and drive gear 82 are shown mounted on the boss. The idle gear is mounted on a circular portion of the boss, so may rotate freely, whereas the drive gear is constrained to corotate with the boss by means of flattened portions of the circular engaging surfaces of the boss and gear.

The drive hook 92 is shown mounted on the boss between the drive gear and the idle gear, and is constrained to corotate with the boss in the same manner as for the drive gear. The annular spacer ring 110, is shown lying between the drive hook and the drive gear.

Still considering FIG. 4, the upper pushrod 150 and the lower pushrod 180 are shown in meshed engagement with the idle gear 80 and drive gear 82 respectively. Each pushrod is held in meshed engagement by means of corresponding upper and lower pushrod guides 170 and 186. A pushrod spacer 172 holds the pushrods apart, keeping the upper pushrod in sliding contact with the back plate 52 and the lower pushrod in sliding contact with the front plate 62 of the casing.

It can be seen in FIG. 4 that the casing is formed from two pressed plates. One plate forms the back plate 52, bottom plate 56 and the two side plates 58, 60 of the casing, and the second plate forms the front plate 62 and the top plate 54. The fore-end plate 70 and fore-end bezel 72 are mounted on the door edge side of the casing. Having described the various components of the three point bolting mechanism, their functions, spatial arrangements and freedoms and constraints of motion, the movements of the mechanism will now be described as the mechanism is taken from a configuration in which the door is open, the bolt and pushrods are retracted, and the deadlock plate is in the unlocked position, to a configuration in which the door is closed, the bolt and pushrods are thrown, and the deadlock plate is in the locked position. The reverse procedure will also be briefly described.

The bolting mechanism is assumed to be in a mortice configuration, mounted in a slot cut in the edge face of a door. The opposing edge face of the door is presumed mounted using hinges onto a vertical member of the door frame, into which the door fits snugly when closed. Apertures in one or both main faces of the door provide for a handle shaft to be fitted through the handle shaft aperture in the centre of the boss, and to enable a key to be inserted into the key cylinder, and turned. A handle is assumed attached to at least one end of the handle shaft to allow a person to rotate the shaft and thus operate the bolting mechanism.

It is further assumed that the upper pushrod is connected to an upper bolt mounted at the upper edge of the door, and that the lower pushrod is connected to a lower bolt mounted at the lower edge of the door. Apertures are provided in the door frame to accept the main bolt and the upper and lower bolts, when the door is in a closed position.

From an open position, with the pushrods and bolt retracted, the door is swung shut into the door frame. A component suitably positioned on the door frame bears on the strike head as the door swings shut. The strike head is pushed into the lock casing and the strike body is pushed horizontally against the action of the strike assembly spring acting on the strike body stop. The horizontal motion of the strike body releases the strike locking pin from the corresponding recess in the upper pushrod 150, freeing the upper pushrod to move vertically.

As the strike locking pin releases the upper pushrod, the tension in the main spring, which applies a torque to the boss, causes the handle shaft, the boss, the drive gear and the drive hook to rotate. The drive gear is in meshed contact with the second small gear, which therefore counter rotates with respect to the drive gear. The first small gear is in meshed contact with the second small gear, so rotates in the same sense as the drive gear. The idle gear, mounted coaxially but not fixed to rotate with the boss, is in meshed contact with the first small gear, so rotates the opposite sense to the drive gear.

The lower pushrod, constrained to move vertically and in meshed contact with the drive gear, is moved downwards by the rotation of the drive gear, providing a bolting action into the lower horizontal member of the door frame by means of the lower bolt mounted towards the bottom of the door. Simultaneously, the upper pushrod, also constrained to move vertically and in meshed contact with the idle gear, is moved upwards as the idle gear rotates in the opposite sense to the drive gear, providing a bolting action into the upper horizontal member of the door frame by means of the upper bolt mounted towards the top of the door.

Simultaneously to the bolting actions of the lower and upper pushrods, the main bolt that is constrained to move horizontally and is in meshed contact with the drive gear, moves horizontally towards the adjacent vertical member of the door frame. The bolt enters a recess in the adjacent vertical member.

With the pushrods and bolt in the thrown position, a key may be inserted into the key cylinder and rotated. This causes the key cylinder rotor cam to rotate, applying a horizontal force to the deadlock plate and a lifting force to the deadlock cam. As this action moves the triangular recess in the deadlock cam clear of the deadlock pin, the deadlock plate moves horizontally, and the thicker section of the deadlock plate slides into confrontation with the upper pushrod stop tag, preventing the tag and hence the upper pushrod from moving out of the thrown position. As the deadlock plate approaches the deadlocked position, and the continued rotation of the key cylinder rotor cam lowers the deadlock cam, the deadlock plate pin enters the second triangular recess of the aperture in the deadlock cam, moving into the apex of the recess as the cam counter rotates under the action of the deadlock cam spring. This provides a restraining force to the further horizontal motion of the deadlock plate.

Because the upper pushrod is constrained from moving vertically by the deadlock assembly, and because the main bolt and lower pushrod are mechanically linked to the upper pushrod by means of the drive gear, the boss, the idle gear and the first and second small gears, the lower pushrod and bolt are also held in position by the deadlock assembly. The door is therefore securely bolted and the bolting mechanism locked.

In opening the door the reverse sequence largely applies to that described above. The deadlock plate must first be moved to the unlocked position, out of confrontation with the upper pushrod stop tag. The deadlock plate is moved to a unlocked position by action of a key in the key cylinder. The boss is rotated against the action of the main spring by an operator turning a handle. Turning the boss corotates the drive gear, counter rotating the idle gear by means of the gear train comprising the first and second small gears. The rotation of the drive gear moves the lower pushrod upwards and the main bolt across, to their retracted positions. The counter rotation of the idle gear moves the upper pushrod downwards into the retracted position.

With the main bolt and the upper and lower pushrods withdrawn, the door is then free to open, while the operator maintains a torque on the boss by use of a handle. As soon as the strike head clears the door frame it is pushed outwardly from the casing through the aperture in the fore-end plate into its protruding position by action of the strike assembly spring. The strike locking pin engages within the adjacent recess of the upper pushrod, and this prevents the upper pushrod from moving vertically, for example by action of the main spring providing a torque on the boss. Thus, when the operator releases the handle, the pushrods and main bolt remain in the retracted position.

The described three point locking bolting mechanism embodiment of the invention is of course only one example of a way in which the invention can be put to practical use, and many variations will be apparent to the person skilled in the art.

It will be appreciated that a multi point bolting mechanism embodying the present invention need not be mounted at the edge of a door, window or other leaf, but that it could, for example, be surface mounted in a more central location, with the main bolt being replaced by a pushrod acting on a bolt positioned towards the door edge. A multi point bolting mechanism embodying the present invention could, for example, comprise a four point bolting mechanism mounted centrally on a rectangular door and providing a bolting action into all four sides of the frame.

Just some of the possible variations in the positions, orientations and modes of use of a multi point bolting action mechanism embodying the invention have already been discussed above. Numerous variations of the described locking bolting mechanism itself will also be apparent. For example, any of the assemblies forming part of the embodiment described above, such as the strike assembly, the deadlock assembly, or the bolt action assembly itself may be used independently of the other assemblies. Only two bolting actions, for example by omitting the main bolt, or more than three bolting actions, for example by adding a further horizontally moving bolt, could easily be provided. Of course, the strike and deadlock assemblies may be used in association with only one bolt or bolting action.

The positions of the components within the casing is also merely illustrative of one convenient way of assembling a multi-point bolting mechanism of the present invention.

Many of the components of the described mechanism, including the casing, the gears and the pushrods, may be conveniently and cheaply made from pressed steel plate. Of course, the skilled person will be aware that a variety of other suitable materials and methods of manufacture could be used. For example, many of the components could be made by casting metal, or from plastics. Equally, the casing and components of the mechanism described are held together in a conventional way, making use of pillars and other components bridging between the front and back plates of the casing, and of lugs and other features pressed form the casing. The skilled man will, of course, be aware that a variety of other constructional methods for all aspects of the mechanism could be used.

In the gearing mechanism of the described embodiment the idle and drive gears are substantially the same size, and have about the same number of teeth, and the same is true of the first and second small gears. However, it may be desirable to vary the sizes and number of teeth of any or all of the gears, for example to change the travel distance of one or more pushrods or bolts. Further gears may also be provided as required, in order to drive further pushrods, or to vary the manner in which the drive and idle gears are rotationally interdriven.

In the described embodiment there is provided a square aperture in bezel plate to fix the orientation of the strike head, which would be otherwise free to rotate within the round aperture of the fore-end plate. This feature is desirable to allow the orientation of the strike head to be changed, in particular to suit the direction of closing of the door. Of course, any other combination of aperture and strike head shapes could be used that would provide the same effect, such as a hexagonal aperture in the bezel plate in combination with a strike head of hexagonal cross section. Furthermore, although a threaded mounting of the strike head to the strike body has been described, a non-threaded rotational mounting, or a simple abutment could be used.

What is claimed is:

1. A mechanism for providing a multi point bolting action to secure a leaf moveable within a frame, comprising:

a drive gear and an idle gear mounted to rotate about substantially the same axis, said idle gear being arranged to rotate in one sense when said drive gear rotates in the other sense;

at least one first member having a rack which is held in intermeshing engagement with said drive gear, said at least one first member being arranged to move between a thrown position and a retracted position when said drive gear rotates;

and at least one second member having a rack which is held in intermeshing engagement with said idle gear, said at least one second member being arranged to move between a thrown position and a retracted position when said idle gear rotates.

2. A mechanism according to claim 1 further comprising a gear train arrangement comprising at least two further gears, a first of the further gears being in intermeshing engagement with said drive gear, and a second of the further gears being in intermeshing engagement with said idle gear.

3. A mechanism according to claim 2 wherein the at least two further gears comprise third and fourth gears, said third gear being in intermeshing engagement with said drive gear and with said fourth gear, said fourth gear being in intermeshing engagement with said idle gear and with said third gear.

4. A mechanism according to claim 1 in which at least one of said members comprises a pushrod that is connected to a bolt, said pushrod and said bolt being arranged to secure said leaf within said frame when said drive gear rotates in one sense, and to release said leaf said leaf when said drive gear rotates in the other sense.

5. A mechanism for providing a bolting action to secure a leaf moveable within a frame, comprising:

at least one member arranged to move between a retracted position and a thrown position to thereby secure the leaf within the frame;

a casing housing at least a part of the mechanism, the casing comprising a fore-end plate which is located adjacent to the frame when the leaf is positioned fully within the frame;

a bezel plate that is removably mounted to the fore-end plate;

a strike head that is arranged to be rotatable about and moveable along a strike head axis substantially normal to said fore-end plate, said strike head being arranged to move within an aperture in said fore-end plate and within a corresponding aperture in said bezel plate, and being arranged to restrain or release movement of said at least one member by an action of said frame on said strike head, said aperture in said fore-end plate allowing rotational motion of said strike head about said strike head axis and said aperture in said bezel plate restricting the rotational motion of said strike head about-said strike head axis.

6. A mechanism according to claim 5 wherein said aperture in said fore-end plate is circular and wherein said corresponding aperture in said bezel plate is rectangular.

7. A mechanism according to claim 5, further comprising a strike body arranged to be movable along said strike head axis between a retracted and an extended travel limit, said travel limits being defined relative to said casing, wherein said strike head is connected to said strike body by threaded means aligned along said strike head axis such that rotation of said strike head about said strike head axis alters the relative positions of said strike head and said strike body in the direction of said strike head axis.

8. A leaf within a frame, comprising a mechanism according to any preceding claim.

* * * * *

UNITED STATES PATENT AND TRADEMARK OFFICE

CERTIFICATE OF CORRECTION

PATENT NO. : 6,478,345 B1
DATED : November 12, 2002
INVENTOR(S) : Viney

It is certified that error appears in the above-identified patent and that said Letters Patent is hereby corrected as shown below:

Column 14,
Line 26, after “said leaf” delete “said leaf”.

Signed and Sealed this

Twenty-ninth Day of April, 2003

JAMES E. ROGAN
*Director of the United States Patent and Trademark Office*